United States Patent [19]

Elhaus et al.

[11] 3,953,247

[45] Apr. 27, 1976

[54] METHOD FOR HEAT TREATMENT OF MATERIAL TO BE WORKED ON, ESPECIALLY OF ALUMINIUM OR MAGNESIUM ALLOYS

[75] Inventors: Friedrich Wilhelm Elhaus, Wuppertal, Germany; Bernhard Hilge, Adliswil, Switzerland

[73] Assignees: Prolizenz AG; Friedrich Wilhelm Elhaus, Chur, both of Switzerland

[22] Filed: Nov. 20, 1973

[21] Appl. No.: 417,509

[30] Foreign Application Priority Data

Nov. 21, 1972 Germany ..... 2256978
Oct. 3, 1973 Germany ..... 2349765

[52] U.S. Cl. ..... 148/13; 148/20.3; 148/157

[51] Int. Cl.[2] ..... C22F 1/04; C22F 1/06

[58] Field of Search ..... 148/13, 20.3, 157, 3

[56] References Cited

UNITED STATES PATENTS

| | | | |
|---|---|---|---|
| 3,296,039 | 1/1967 | Loeck et al. | 148/157 |
| 3,496,033 | 2/1970 | Gilbreath et al. | 148/157 |

*Primary Examiner*—R. Dean
*Attorney, Agent, or Firm*—Ernest F. Marmorek

[57] ABSTRACT

For heat treatment metal pieces like billets, ingots, bars and the like are pre-heated by direct flame impingement in a pre-heating furnace and then transfered into a holding furnace with forced hot gas circulation where they are held for the time required at the desired heat treatment temperature.

12 Claims, 4 Drawing Figures

Figure 2:
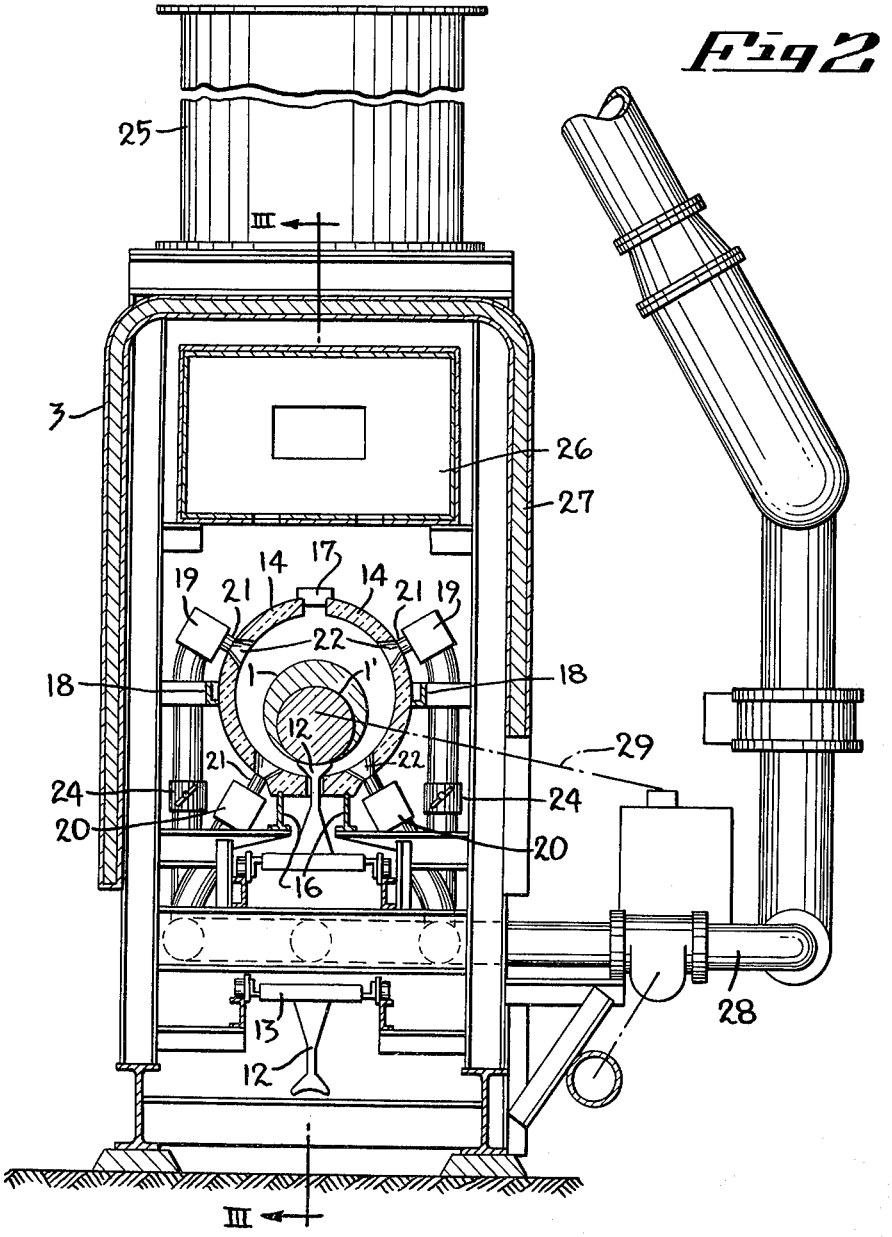

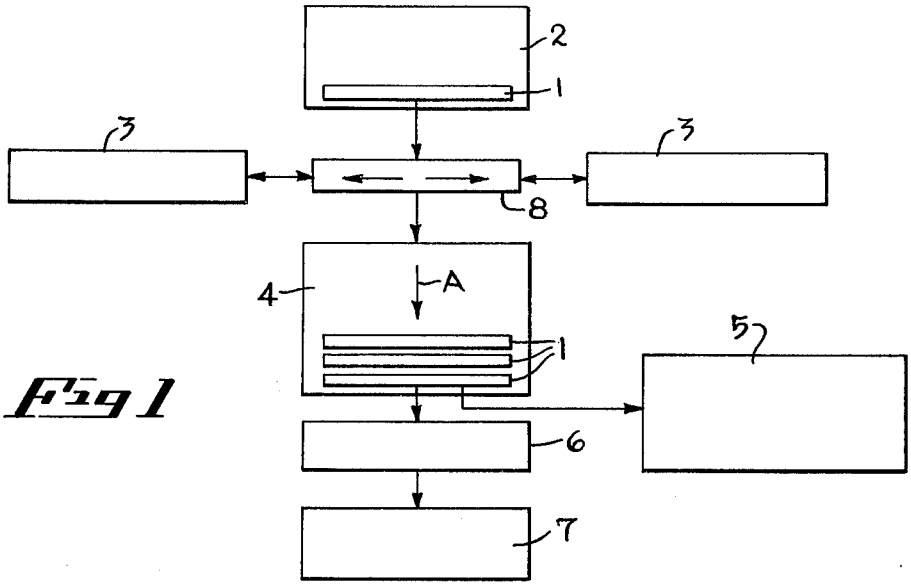
Fig 1
Fig 3
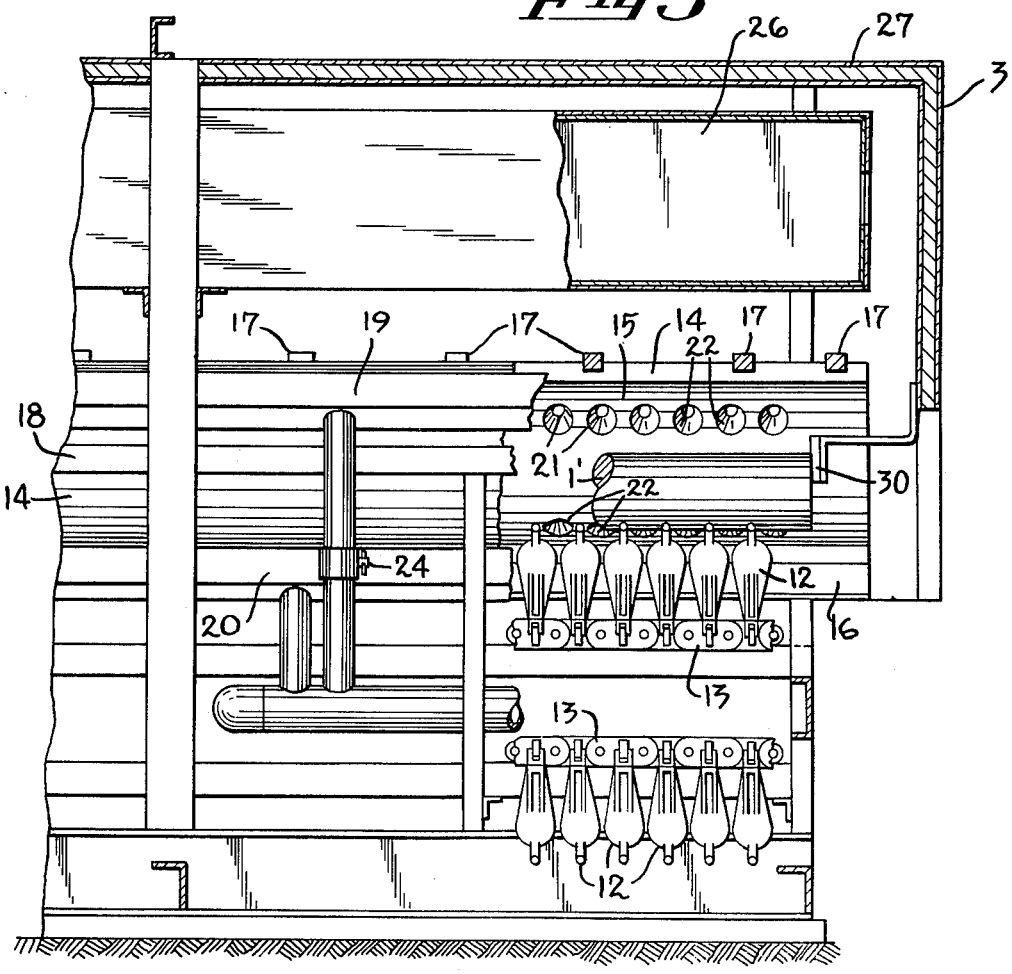

25
III
3
26
27
14
17
14
19
21
21
19
22
1
1'
18
18
12
29
21
22
24
24
20
20
16
28
13
12
III

METHOD FOR HEAT TREATMENT OF MATERIAL TO BE WORKED ON, ESPECIALLY OF ALUMINIUM OR MAGNESIUM ALLOYS

The invention relates to a method and an apparatus for heat treatment of material to be worked on, such as cast strips and billets, as well as ingots, rods, tubes and the like, especially of aluminium or magnesium alloys, in which the material is first pre-heated at a temperature higher than the heat treatment temperature and thereafter is held at a desired heat treatment temperature.

Cast strips or billets or extrusion and rolling products and are customarily subjected to a heat treatment in order to subject the material to homogenisation, heterogenisation, or another hot treatment. For example, continuously cast billets of aluminium alloys are first pre-heated after the casting, then fully annealed at temperatures between 500° and 620°C, and eventually thereafter cooled. During this the billets receive the structure desired for further working, e.g. for extrusion or rolling.

In a known heat treatment method for billets of aluminium or magnesium alloys, a chamber or shaft furnace with forced circulation of furnace atmosphere is supplied with the billets. The material to be treated is first pre-heated to full annealing temperature and thereafter is held at this temperature during a predetermined period of time.

It is usual to introduce the material into such a chamber or shaft furnace in batches with several billets with their longitudinal sides lying against one another in each batch into the furnace. In doing this, differences in quality cannot be avoided, because account cannot be taken that the inner billets of the batch require a longer heat treatment period than the outer billets. Difficulties arise also during cooling of the entire batch, in which warping of individual strips or billets cannot be avoided.

The material is customarily pre-heated with circulated hot gas, flue gas or with circulated hot air, the temperature of which lies about at the full annealing temperature. By reason of the comparatively slight temperature of such a source of heat or "heater", the pre-heating lasts very long, and as a rule significantly longer than the subsequent full annealing.

If the material is to be handled in moving condition, i.e. in continuous flow operation, then one tries to transport the material with equal speed through the pre-heating zone and the holding zone in the furnace. By reason of the pre-heating of long duration referred to, then either the pre-heating zone must be formed disproportionately long, or the material upon entry into the holding zone has not yet attained the annealing temperature.

In order to achieve different annealing temperatures, the temperature of the hot gas in the pre-heating phase or zone and the holding phase or zone must be finely controllable. This appears to be very difficult. Moreover a change in temperature of the hot gas is only possible within narrow limits. Furthermore, the material is transported with equal speed through the preheating zone and the holding zone.

All this imposes a restricted flexibility, i.e. a restricted ability to match desired different working requirements, e.g. for handling of a different material or for achieving of a different quality.

An object of the invention is to provide a method and an apparatus of the kind referred to initially, with which a material of consistent quality can be produced and at the same time a better ability to match a variable cycle sequence can be achieved, which can be necessary because of different desired structures, different previous and subsequent auxiliary apparatus in the case of the further treatment, interrupted operation or operation under part load, and the like.

In a method referred to initially it is provided according to the invention that the material is pre-heated by direct flame impingement and thereafter is held hot by forced circulation of hot gas at a controlled temperature, and that the material is moved in the pre-heating phase and in the holding phase with speed and/or cycle sequence adjustable independently of one another, in such a way that the entire heat treatment occurs at least largely continuously.

An apparatus of the kind referred to initially is characterised according to the invention by at least one pre-heating furnace with burners, the flames of which impinge directly on the material, a holding furnace in which the material is heated by forced circulation of hot gas, and transport devices for the material to be treated, associated with the two furnaces and drivable independently of one another.

With the method and the apparatus according to the invention a series of advantages can be achieved during the heat treatment:

With the pre-heating by direct flame impingement the pre-heating time is substantially shorter than the holding time.

To achieve a high production speed, in most cases a plurality of preheating furnaces is provided for supplying one holding furnace the number of pre-heating furnaces depending of the composition of the material to be treated and of the treatment conditions. For treatment of smaller cross sections less or only one pre-heating furnace could be provided, in some cases in connection with a plurality of holding furnaces.

The forced circulation of hot gas, e.g. hot air or flue gas makes possible to exactly and uniformly control the temperature in the holding phase and thereby to achieve a product of high and consistent quality.

By the individual handling of the material, i.e. the handling not of package-like batches, but of long individual strips or groups of short billets lying one behind the other, a uniform quality is ensured, because each individual strip or billet finds the same pre-heating and holding conditions. The reduction of the pre-heating time makes possible a better matching of the pre-heating and holding phases one after the other. For example the time for pre-heating a billet of an aluminium alloy to a peak temperature of 500° to 570°C amounts, according th billet diameter, to 10 to 30 minutes. With separately pre-heating the billets an axact temperature check during the pre-heating procedure is possible. The temperature check as well as the individual adjustability of the cycle sequence or speed of the material in the pre-heating furnace and in the holding furnace make possible a matching to an adjusted cycle sequence, with great flexibility, as may be desirable on the grounds of subsequent apparatus, different alloys to be handled, interrupted operation and operation under part load.

Because of the large pre-heating power of the preheating furnace and the end enhanced throughput, the ratio of capital costs to production capacity in an apparatus according to the invention is lower than in known apparatus. The method and the apparatus according to the invention finally permit a continuous flow of material. All this leads to a significant rationalisation effect in comparison with the known methods and apparatus.

A significant contribution to increase of the flexibility lies in the fact that the temperature-time progression during pre-heating is adjustable.

The billets can be conveyed step-by-step and each individually be pre-heated in stationary condition in the pre-heating furnace.

However a continuous supply and pre-heating of the billets in continuous flow with intermediate pause is possible. A pure continuous flow operation in the pre-heating phase is as a rule not attainable for the reason that the pre-heating time and the holding time cannot be sufficiently attuned one after the other.

In practice operation of the pre-heating furnace as a chamber furnace, i.e. a furnace with input and output at one and the same side proved to be particularly useful.

By the individual treatment of the material, not only is a uniform quality ensured, but also measures against warping or curling of the billets are made possible. For this purpose it is particularly advantageous if the billets are rotated about their longitudinal axes during the holding. Such a rotation has appeared to be appropriate for avoidance of warping or curving also during the cooling following the heat treatment.

If the material is supplied step-by-step, and is pre-heated in stationary condition, then in a preferred apparatus according to the invention, it is able to be positioned in the pre-heating furnace in a predeterminable position. In this connection at least one limit switch for the control of the transport device can be arranged in a position in the pre-heating furnace, in which the material is positioned in the desired manner.

In order to be able to pre-heat different billet lengths without waste of energy, in a developed apparatus according to the invention measuring devices are provided for measurement of the length of the material introduced into the pre-heating furnace, and the heating devices are sub-divided into groups, which are controlled by means of the measuring devices, in accordance with the length of the material.

A particularly suitable arrangement is provided in that between the preheating furnace and the holding furnace there is arranged an intermediate transport device, which serves for transference of the material to be treated from a supply device to the pre-heating furnace and from this to the holding furnace. In this connection the pre-heating furnace and the holding furnace can be arranged with their two transport devices transversely to one another, and then the intermediate transport device suitably works reversibly.

The holding furnace is preferably heatable electrically or with fuel and has a hot air or flue gas atmosphere.

The method according to the invention is applied advantageously with material of relatively great dimensions, e.g. with cross-sections of 1, 5 $mm^2$; diameters of 50 cm and lengths of 7 m. It was hardly possible so far to achieve uniform quality and also high output when treating material of such dimensions.

Figure 4:
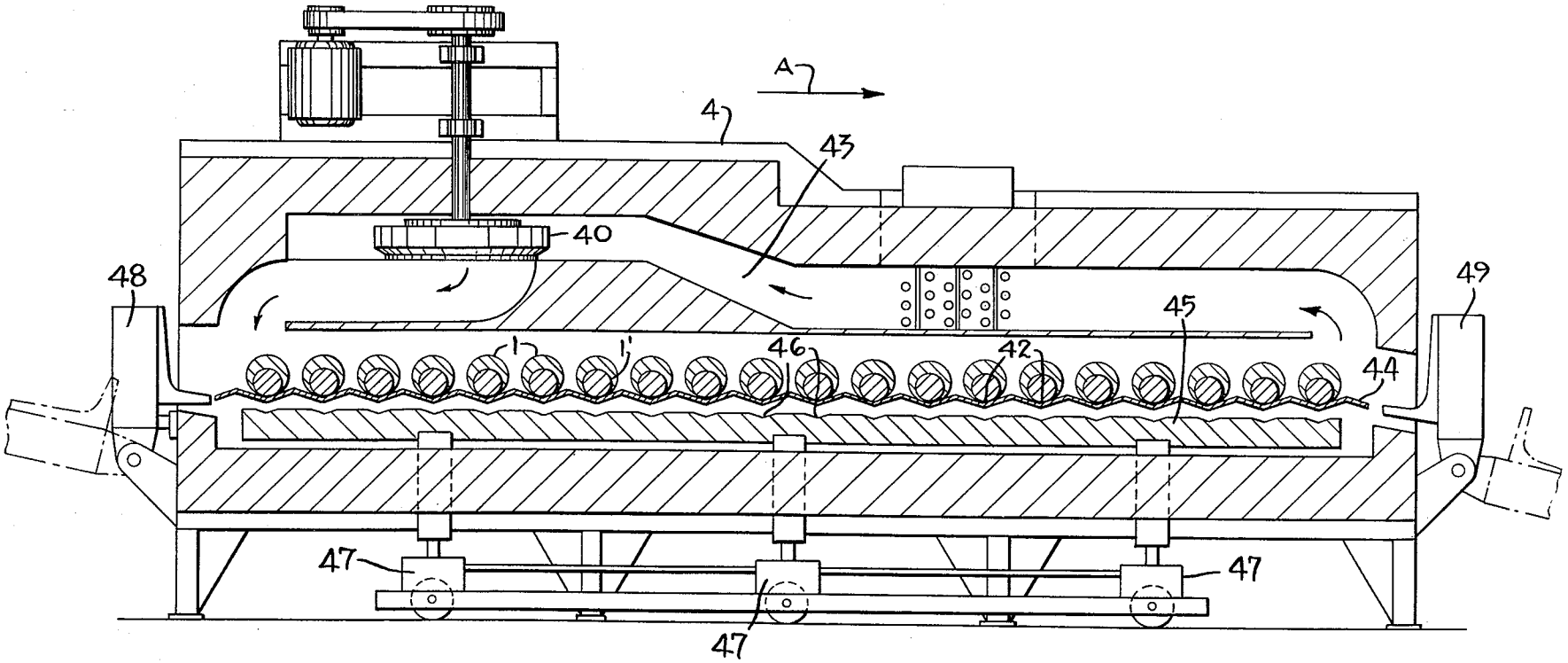

The invention is more closely described with further details below, with reference to schematic drawings by way of constructional examples. These show:

FIG. 1 a schematic view of an apparatus according to the invention with a pre-heating furnace and a holding furnace arranged directly after;

FIG. 2 a cross section through a pre-heating furnace which is preferably employed in an apparatus according to the invention;

FIG. 3 a section on the line III—III in FIG. 2;

FIG. 4 a longitudinal section through a holding furnace which can be employed in the apparatus according to the invention.

In the schematic plan according to FIG. 1, billets are indicated with the reference numeral 1. From a supply device or a magazine 2, the billets or bars 1 are automatically transferred individually to a transport device 8, which can supply step-by-step, in the direction of the horizontal arrows, into associated pre-heating furnaces 3 arranged to left and right of it as seen in FIG. 1. The billets or bars 1 are brought rapidly to full annealing temperature individually in the pre-heating furnace 3 in stationary condition by direct flame impingement by means of burners. Thereafter the individually pre-heated billets are taken out again from the respective pre-heating furnace 3, and are transferred individually in succession from the transport device 8 into a holding furnace 4. This holding furnace is formed as a continuous flow furnace, and operates with circulated hot gas, e.g. hot air. The full annealing temperature is maintained over the length of the holding furnace, or, in the case in which the billets at the entry into the holding furnace have not yet entirely attained the full annealing temperature, is reached after a short travel in the holding furnace.

By alteration, of the pre-heating time, that is of the period of time in which the billets 1 are held in the pre-heating furnace 3, and by control of the burners, the pre-heating temperature can be adjusted finely and over a wide range, while at the same time a uniform pre-heating of the billets is always obtained.

The holding time in the holding furnace 4 can be varied according to the alloy composition of the billets and the desired structure by alteration of the speed of through travel. The temperature in the holding furnace 4 can be altered, for example by control of the temperature of the hot air gas.

In the holding furnace 4 devices are provided for rotation of the billets 1 about their longitudinal axes, so that these are completely uniformly heated and warping or curving cannot arise. The bars, plasticised by the annealing, automatically straighten themselves by reason of their own weight. If the heat treatment does not require a cooling, and the holding or full annealing temperature is suitable for further working, e.g. for pressing or rolling, the billets emerging from the holding furnace 4 can be conveyed directly to a further working device 5 e.g. to a press or to a rolling mill.

In the usual case, however the billets are conveyed from the outlet of the holding furnace 4 to a cooling station 6, where the billets are individually cooled in continuous flow with water and/or air. At the cooling station 6 there is arranged a device, not shown, for rotation of the bars during the cooling, so that here also, by reason of uniform cooling action from all sides, warping or curvature of the billets is avoided.

From the cooling station 6, the billets 1 arrive in a magazine 7, out of which they can be supplied to the further working at another place.

The separation of pre-heating and holding opens up the possibility of an individual control of the temperature and especially of the cycle sequence or the transport speed in the pre-heating and the holding phase. This leads to a very high flexibility of the entire apparatus, i.e. the possibility of matching to an optimum extent in each case to the differing requirements in operation, such as the production of the different full annealing temperatures desired in practice with different alloys, an interrupted operation or a partly loaded operation matching following apparatus or stocks in the billet supply. Because of the rapid heating with direct flame impingement, the pre-heating furnace is built smaller than hitherto, so that the space requirement of the entire installation is reduced. The material flow is significantly improved, and the material throughput is raised by reason of the continuous or quasicontinuous running.

FIGS. 2 and 3 show in details a pre-heating furnace which is preferably employed.

The pre-heating furnace has such a length that a billet of the greatest length occuring in practice (7 to 8 metres) does not exceed that length. In the pre-heating furnace 3 there is provided a double-run conveyor chain 13 with carrier devices 12 fixed to it for the billets 1 to be pre-heated. The carrier devices 12 extend through a longitudinal slot into a cylindrical furnace chamber 15 formed by two furnace shells 14. The furnace shells are each journalled to swing by their lower ends on a carrier rail 16 and are held together above by spacing members 17. Laterally the furnace shells are supported on the furnace wall by supporting bars 18. By removal of the spacing members 17 and slight swinging inwards around the supporting points on the carrier rail 16, the furnace shells 14 can be dismantled without difficulty.

The furnace shells 14 have four radially directed rows of openings 22, into which open nozzles 21, likewise radially directed, of pre-mixed burners 19, 20. The radially directed rows of burners extend over the entire length of the furnace shells 14. In so doing, the lower rows of burners 20 are arranged close to the supporting devices 12 and directed obliquely upwards, while the two upper rows of burners are offset through about 90° to the corresponding lower rows of burners and directed obliquely downwards. The upper rows of burners 19 can be adjusted with respect to the lower rows of burners 20.

By reason of the arrangement described of the rows of burners 19, 20, during heating of billets 1 or 1′ (of smaller diameter) the surfaces for heat transfer are employed in an optimum manner, so that a circularly symmetrical temperature distribution over the cross section of the billets is achieved. The burner nozzles 21 are at this time differently adjusted in their output, so that the temperature distribution desired in each case is achieved.

The carrier devices 12 for the billets 1 or 1′ have, at the place where they penetrate into the slot formed between the two furnace shells 14, a shaft which is rectangular in cross section, which fills up the slot except for a safety spacing necessary for thermal expansion.

The flue gases leave the furnace cavity 15 upwards through the slot formed by the furnace shells 14 and the spacer members 17, and are, together with fresh air, sucked away through a suction fan along the exhaust duct 26. The outer casing 27 serves in this connection at the same time as an air guide for the fresh air sucked in with it.

The pipes 28 necessary for the mixing and metering of the combustion gas, as well as a device 29 for movement of the temperature of the billets 1 or 1′, are arranged at the right hand side of the furnace as seen in FIG. 2.

For preheating, the billets are pushed into the furnace from the transport device 8 and are taken over by the carrier device which are moved by the double-run conveyor chain 13. The drive for the double-run conveyor chain is controlled by a limit not shown, which turns off the drive, when a billet 1 runs against an abutment 30 at one end of the furnace shells 14.

Measuring devices, not shown, arranged at uniform spacings over the length of the furnace shells 14, measure the length of the billet inserted at each moment. These measuring devices control the burners 19 and 20 in groups, so that at each moment only a number of burners corresponding to the length of a billet is actuated for pre-heating. The burners are first switched on, when a corresponding billet 1 has reached the position shown in FIG. 3 against the abutment 30.

With shorter billet lengths, it is also possible that the pre-heating furnace 3 is supplied with a plurality of billets.

With the pre-heating furnace shown, a continuous flow operation is also attainable. The billets 1 are then pre-heated in moving condition. Then the drive is however preferably intermittent in this case, so that the necessary matching with the following period of annealing in the holding furnace is achieved.

The holding furnace 4 shown in FIG. 4 in longitudinal section is formed for continuous flow operation and is heated with hot gas, e.g. hot air, which is blown by a radial-axial blower 40 against the billets 1 or 1′ which are to be kept hot, and is circulated in the furnace.

The billets lie in saw-tooth-shape depressions 42 of beams 44 extending longitudinally through the furnace cavity 43, and are capable of being fed forward together step-by-step by means of lifting beam 45 from one depression into the then adjacent depression in the feeding direction (arrow A in FIG. 1 and 4). The lifting beam 45, which is movable by a lifting and transporting drive indicated at 47, also has depressions 46 for reception of the billets 1 or 1′ for transport.

In FIG. 4 the billets 1 or 1′ are shown in their position of rest on the beams 44 and the lifting beam 45 in lowered position.

With the same cycle as the lifting motion of the lifting beam 45, the furnace doors 48, 49 for supply and delivery respectively of billets are opened. The doors are shown partially in broken lines in opened position.

We claim:

1. In a method for heat treating metal pieces comprising aluminum or magnesium alloys in the form of ingots, rods, tubes, strips or billets, the heat treatment being of the type wherein the metal piece is subjected to a preheat cycle in a preheat apparatus followed by a heat treatment cycle in a heat treatment apparatus separate from and independent of said preheat apparatus, and subsequent cooling, the steps comprising:

preheating said metal piece in said preheat apparatus during the preheat cycle, by direct flame impingement, whereby a rapid preheating of the metal piece may be accomplished; and thereafter transferring it to said heat treatment apparatus, and subsequently maintaining said preheated metal piece at a desired heat treatment temperature in said heat treatment apparatus, during the heat treatment cycle, the speed of the metal piece, if any, through each apparatus being independently adjustable, and adjusting the speed through each apparatus.

2. In a method as claimed in claim 1, wherein the duration of the heat treatment cycle and the duration of the preheat cycle are adjustable independently of each other.

3. In a method as claimed in claim 2, wherein the duration of the heat treatment cycle and the preheat cycle are substantially equal.

4. In a method as claimed in claim 1, wherein there are a multiplicity of heat treatment apparatus fed by one preheat apparatus comprising the steps of:

adjusting said preheat cycle to be of short duration with respect to said heat treatment cycle whereby an increased hourly capacity is obtained by using the multiplicity of heat treatment apparatus to heat treat an increased output of metal pieces from the shortened preheat cycle.

5. In a method according to claim 1, wherein there are a multiplicity of metal pieces having elongated axes and being heat treated in succession, further comprising the steps of rotating said pieces about their elongated axes; and simultaneously cooling each piece individually after the heat treatment cycle is completed.

6. In a method, as claimed in claim 1, the speed through each apparatus being adjusted in such a way that the method results in a substantially continuous operation.

7. In a method as claimed in claim 6, said preheating cycle comprising heating, rapidly, said metal pieces to a temperature in excess of the desired heat treatment temperature; and subsequently reducing the preheating cycle temperature substantially to the desired heat treatment temperature.

8. In a method as claimed in claim 1, wherein there are a multiplicity of preheat apparatus feeding at least one heat treatment apparatus.

9. Method according to claim 1, characterised in that the temperaturetime curve during the pre-heating cycle is adjustable.

10. Method according to claim 1, characterised in that the metal pieces is rotated about its longitudinal axis during the heat treatment.

11. Method according to claim 1, characterised in that an operation for cleaning of its surface, which can be combined with the cooling, follows the heat treatment of the material.

12. Method according to claim 1, characterised in that the material is individually checked after the heat treatment for inclusions, cavities and cracks, preferably by means of ultrasonic action.

* * * * *